US005823575A

United States Patent [19]

Ives

[11] Patent Number: 5,823,575

[45] Date of Patent: Oct. 20, 1998

[54] ADVERTISING CHECK

[76] Inventor: John E. Ives, 1400 S. Lipan St., Denver, Colo. 80223

[21] Appl. No.: 708,699

[22] Filed: Sep. 5, 1996

[51] Int. Cl.[6] ..... B42D 15/10

[52] U.S. Cl. ..... 283/58; 283/56

[58] Field of Search ..... 283/56–59; D19/11

[56] References Cited

U.S. PATENT DOCUMENTS

| | | | |
|---|---|---|---|
| 4,685,699 | 8/1987 | Hirasawa . | |
| 4,722,554 | 2/1988 | Pettit | 283/56 X |
| 4,817,949 | 4/1989 | Bachmann . | |
| 4,906,026 | 3/1990 | Gordan, Jr. et al. . | |
| 5,060,979 | 10/1991 | Garza . | |
| 5,085,470 | 2/1992 | Peach et al. | 283/58 |
| 5,324,077 | 6/1994 | Kessler et al. | 283/58 X |
| 5,344,192 | 9/1994 | Phillips . | |
| 5,427,413 | 6/1995 | Garza . | |
| 5,483,049 | 1/1996 | Schulze . | |
| 5,566,981 | 10/1996 | Alcordo | 283/58 |
| 5,594,226 | 1/1997 | Steger | 283/58 X |
| 5,622,388 | 4/1997 | Alcordo | 283/58 |

FOREIGN PATENT DOCUMENTS

| | | | |
|---|---|---|---|
| 2612325 | 9/1988 | France | 283/58 |
| 8200844 | 10/1983 | Netherlands | 283/58 |
| 3629 | of 1883 | United Kingdom | 283/58 |

*Primary Examiner*—Frances Han

[57] ABSTRACT

An advertising check (10) having a checking account name (12A) printed thereon. The advertising check (10) further has a check pay endorsement (14A) printed thereon. The advertising check (10) further has a check date (14B) printed thereon positioned above and adjacent to the check pay endorsement (14A). The advertising check (10) further has a check pay amount box (14C) printed thereon. The check pay amount box (14C) further has a correlating check pay amount box script (14CA) printed adjacent thereto. The advertising check (10) further has a check financial institute clearing code (14E) printed thereon positioned along a bottom edge. The advertising check (10) further has a retail product graphical display (16A) printed thereon. The retail product graphical display (16A) further has a correlating retail product graphical display textual information (16AA) printed adjacent thereto. The advertising check (10) further has a retail product dealer name (16B) printed thereon adjacent to the retail product graphical display (16A).

4 Claims, 1 Drawing Sheet

ADVERTISING CHECK

BACKGROUND OF THE INVENTION

1. Field of the Invention

The present invention relates to an advertising check. More particularly, the present invention relates to an advertising check displaying a retail product graphical display with associated retail product graphical display textual information, a retail product dealer name with associated retail product dealer address and retail product dealer telephone number as well as optionally a retail product salesman's name 2. Description of the Prior Art Checks used in banking are well known in the art. The majority have printed indicia thereon as follows: checking account name, checking account address, checking account telephone number, check pay endorsement, check date, check pay amount box with associated check pay amount box script, check memo, check financial institute clearing code, and check financial institute name and address. However they lack the utilitarian functional features as follows: retail product graphical display having associated retail product graphical display textual information. The retail product graphical display relates to a retail product dealer name having associated retail product dealer address and retail product dealer telephone number also printed thereon adjacent thereto. In addition, optionally a retail product salesman's name may be printed adjacent to the retail product dealer name. The functionality of the advertising check is the association of the retail product graphical display etc. and the retail product dealer name etc. in association with one another which subliminally works on a check writer's mind wherein when the check writer has sufficient funds available in the checking account, he/she will retrieve the subliminal message on the check to a conscience message of thought and thereby call the retail product dealer telephone number which is associated with the retail product graphical display to purchase the product displayed thereon. A similar response is expected from all persons handling the check, including the payee.

Numerous innovations for checks and related products have been provided in the prior art that are described as follows. Even though these innovations may be suitable for the specific individual purposes to which they address, they differ from the present invention as hereinafter contrasted.

In U.S. Pat. No. 4,817,949, titled Automated Teller Machine transaction Receipts With Integral Promotional Game, invented by Bachmann et al., a receipt stock with integral game to promote the use of automated teller machines by bank customers is disclosed. The reverse side of the receipt contains playing spaces contiguously disposed along a longitudinal edge of the receipt stock which does not contact the press rollers which convey the receipt through the ATM. Game indicia are printed on the playing spaces, and a protective coating of clear varnish is applied over the indicia. To conceal the game indicia from view until the receipt is distributed to a customer, an opaque masking layer of latex is applied over the playing spaces. The protective coating of varnish prevents the masking layer from penetrating the surface of the paper and thus promotes easy removal of the masking layer by the game player, e.g. by scraping with the edge of a coin. The selecting application of the protective coating only to surfaces of the receipt which do not contact the press rollers prevents the receipt stock from slipping when engaged by the rollers. Similarly, the selective positioning of the playing spaces so as not to contact the press rollers prevents the rollers from damaging the latex masking layer and fouling the drive mechanism of the ATM.

The patented invention differs from the present invention because the patented invention comprises a removable varnish coating on a receipt that discloses figures and icons representing particular values. The present invention discloses a picture or design on a negotiable personal or company bank check that is not covered or hidden by a varnish or any other coating. Further, the patented invention incorporates the figures or icons for the purpose of representing values in a promotional game. The present invention discloses includes a photograph or image in the background of a check for the purpose of advertising and promoting a particular product.

In U.S. Pat. No. 4,685,699, titled Promotional Article, invented by Hirasawa, an improved structure and method for a promotional article is provided. A multi-page structure includes one or more pages of gallery-quality paper for receiving on their first sides high quality printed reproductions suitable for retention and framing as an immediate incentive gift for the recipient, and on their second sides promotional information and/or advertisements. Redeemable coupons for use in conjunction with the promotional and/or advertising copy are also provided by a structure adapted to permit removal of the coupons without reducing the value or impact of the incentive gifts. The resulting structure may be used as a free standing insert for newspapers or other publications, or alone as a promotional brochure.

The patented invention differs from the present invention discloses because the patented invention is based on a separate free-standing device for containing high-quality reproduction photographs and images. The patented invention is a multi-paged framing apparatus which can be used for promotional purposes. The present invention discloses not the use of a new structure, but incorporates a promotion or advertisement into the background design of a personal or company bank check. The patented invention further discloses the usage of coupons or credits for the consumer towards the retail products promoted.

In U.S. Pat. No. 5,483,049, titled Coupon Exchanging And Check Writing System, invented by Schulze, Jr., an electronic coupon exchange system is disclosed whereby the exchange system both generates and redeems coupons. Upon entering a retail sales store, consumers can exchange conventional coupons for exchange systems coupons which are only applicable to the retail store entered. The exchange system invalidates a conventional coupon and prints an exchange system coupon for a product promoted by the coupon exchange system. Consumers are enticed to use the exchange system coupons since the coupons can be redeemed for cash via checks printed immediately upon redemption of the coupons or by having an account credited. Consumers are also enticed to use the new coupons by games and bonus prizes associated with the exchange system coupons. The exchange system exchanges system coupons without the use of retailer funds. Thus, retailers obtain full price for products purchased with the exchange system coupons. Data stored by the exchange system for printing an exchange system coupon can be modified remotely at substantially any time. Thus, exchange system coupons can be modified as needed to target consumers patronizing a particular retail sales store by offering exchange coupons having sufficient discounts or other enticements to motivate consumers into using the exchange system coupons.

The patented invention differs from the present invention discloses because the patented invention incorporates an electronic system for the purpose of facilitating the usage of retail store coupons by consumers. Further, the patented invention teaches a system by which to exchange the coupons for store credit or even cash. The present invention discloses not a coupon system but a decorative and stylish promotion or advertisement of a particular product in the background of an ordinary check. In addition, the present invention does not require the usage of any electronic tracking means.

In U.S. Pat. No. 5,344,192, titled Visual Validation Mark For Bank Checks And Other Security Documents, invented by Phillips, a method for producing a validation mark on security paper includes printing the mark on the paper using an ink that has the same color as the paper but which as more uniform directional reflectance than the sheet of paper. That is, the dried ink is a more uniform diffuse reflector than is the paper. When the mark is illuminated by a light source located on one side of the mark, the mark appears lighter than the paper around it when viewed from the same side as the light source, but the mark appears darker than the paper around it when viewed from the side opposite the light source. An exemplary formulation is given.

The patented invention differs from the present invention discloses because the patented invention teaches the usage of a watermark on checks and other negotiable instruments for security and anti-fraud purposes. The watermark design of the patented invention can only be seen by tilting the instrument at a special angle. The present invention discloses a photograph or image in the background of a standard bank check to be seen prominently from a straight-on or any other angle. The present invention teaches the usage of this image for advertising and promotional purposes, not as a method for ensuring veracity and promoting security.

In U.S. Pat. No. 5,060,979, titled Information Pad For Checkbooks, invented by Garza, an information pad for checkbooks that comprises a checkbook cover having flexible material, and an information receiving pad that is flexibly fastened to an edge of the checkbook cover is disclosed. The checkbook cover is a type that has a suitable slot for receiving checkbooks. The information receiving pad has a size less than the area of the checkbook cover. The information receiving pad includes a backing layer and a plurality of flexible sheets detachably connected to the backing layer. The backing layer has a first planar surface and a second planar surface. The plurality of flexible sheets are suitable for the receipt of written information. A hinge member extends between the edge of the backing layer and the edge of the checkbook cover so as to allow the information receiving pad to be folded within the cover.

The patented invention differs from the present invention discloses because the patented invention is based on a separate pad attached to the outer surface of a checkbook for the purpose of receiving and storing various papers and other matter within. The receiving pad of the patented invention is flexibly fastened and allows for additional sheets to be affixed thereto. The present invention teaches not a separate item attached to checks or a checkbook cover, but instead incorporates an advertisement or promotional image on the face of a conventional check itself.

In U.S. Pat. No. 5,427,413, titled Information Pad, invented by Garza, an information pad for checkbooks including a cover of a flexible foldable plasticized material, a plurality of sheets affixed together along a common edge, a backing layer affixed to the plurality of sheets and having a front side and a back side, and a hinge member affixed to the backing layer and extending outwardly beyond the common edge of the plurality of sheets. The hinge member is adhesively affixed to the cover. The cover is a checkbook cover. The hinge member has an adhesive strip extending there across for engaging the cover. The hinge member is affixed to the backside of the backing layer. The frontal surface of the hinge layer has a display area formed thereon for the display of advertising indicia. The hinge member has a length corresponding to an edge length of the backing layer.

The patented invention differs from the present invention because the patented invention is based on a separate pad attached to the outer surface of a checkbook for the purpose of receiving and storing various papers and other matter within. The receiving pad of the patented invention is flexibly fastened and allows for additional sheets to be affixed thereto. The patented invention further comprises a hinge mechanism and a foldable plastic material for enclosing the attached information. The present invention discloses not a separate item attached to checks or to a checkbook cover, but instead incorporates an advertisement or promotional image on the face of a conventional check itself. The present invention does not use a hinge mechanism of any sort or a plasticized material of any sort in adding the image to the consumer's personal or company check.

In U.S. Pat. No. 4,906,026, titled Subliminal Checkbook System, invented by Gordon, Jr., disclosed is a pad of bank checks in which the check pad comprises multiple logos containing advertising coupons which are designed to be perforated for easy removal, and a series of bank checks each with a rotating advertising logo and/or slogan matching the sequential representation of the coupons.

The patented invention differs from the present invention because the patented invention is based on a system in which additional separate advertisements are inserted in a series of bank checks, to be removed by tearing along a perforation embodied therein. The number of coupons used in the patented invention by Gordon, Jr. correlate directly to the number of bank checks in the checkbook, and are to be removed from the book for the purpose of cashing in at a variety of retail institutions. The present invention, in contrast, does not teach the use of a separate advertising or promotional item, but instead incorporates an advertisement on the face of a personal or bank check itself. Thus, the present invention discloses not a coupon system but a decorative and stylish promotion or advertisement of a particular product in the background of an ordinary check.

Numerous innovations for checks have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to an advertising check. More particularly, the present invention relates to an advertising check displaying a retail product graphical display with associated retail product graphical display textual information, a retail product dealer name with associated retail product dealer address and retail product dealer telephone number as well as optionally a retail product salesman's name.

The present invention are bank checks which are personal, commercial or other forms of financial banking notes which display a retail product printed in the background for the purpose of subliminally advertising that particular product. The retail product display may cover the entire face of the check or partial covering thereof. For example, if the retail product is a car, the make, model and/or manufacturer and specific retailer/dealer/distributor of that particular model and which may or may not include the manufacturers similar models are collated throughout the checkbook in alternating sequences. The checkbook may also consist of checks in single, double, triple and computer generated formats. As new makes and models of the retail merchandise occur each year, they are incorporated into the checkbook to allow better advertising of a dealer's and/or manufacturer's new product line.

The advertising checks provide an novel approach to advertising products visually and subliminally for dealers and manufacturers. The advertising checks also provide an opportunity to have a product printed in multi-color, or single color with associated retailer's name, location and telephone number. An advertising slogan may also be printed thereon. The advertisement on the check is viewed and thereby subliminally enters the mind of every person who handles the check such as the check writer, check recipient, bank clerk, bank coder, etc. The advertising check also allows an opportunity for the check writer to give a verbal testimonial about that particular product and/or retailer when the colorful photo captures the attention of the check receiver. The advertising check also allows the dealer and/or manufacturer long term exposure of current models of their products to the check users which can be useful in retaining that person as a customer by continuously keeping their product and the name in front of the customers for the life of the checks.

One type of problem encountered in the prior art is that advertising lacks novel approaches as found in the present invention.

In the prior art, unsuccessful attempts to solve this problem were attempted namely: classical types of advertising in printed media, television and radio. However, the problem was solved by the present invention because it is a novel approach which places the advertised product in a subliminal state within one's mind.

Innovations within the prior art are rapidly being exploited in the field of advertising.

The present invention went contrary to the teaching of the art which teaches new methods of the classical advertising themes.

The present invention solved a long felt need for a new, novel and unique approach to advertising.

The present invention produced unexpected results namely: subliminal advertisement.

A synergistic effect was produced utilizing the present invention due to the following facts and results from experimentation: the subliminal advertisement lasted a prolonged period of time, namely, throughout the life cycle of the retail product to be sold and displayed.

Accordingly, it is an object of the present invention to provide an advertising check which comprises standard well known features such as checking account name, checking account address, checking account telephone number, check pay endorsement, check date, check pay amount box with associated check pay amount box script, check memo, check financial institute clearing code, and check financial institute name and address.

More particularly, it is an object of the present invention to provide a combination of the standard features in conjunction with novel features such as retail product graphical display with associated retail product graphical display textual information, retail product dealer name, retail product dealer address, retail product dealer telephone number and retail product salesman's name.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—advertising check (10)
12A—checking account name (12A)
12B—checking account address (12B)
12C—checking account telephone number (12C)
14A—check pay endorsement (14A)
14B—check date (14B)
14C—check pay amount box (14C)
14CA—check pay amount box script (14CA)
14D—check memo (14D)
14E—check financial institute clearing code (14E)
14F—check financial institute name and address (14F)
16A—retail product graphical display (16A)
16AA—retail product graphical display textual information (16AA)
16B—retail product dealer name (16B)
16C—retail product dealer address (16C)
16D—retail product dealer telephone number (16D)
16E—retail product salesman (16E)

DESCRIPTION OF THE PREFERRED EMBODIMENT

Figure 1:
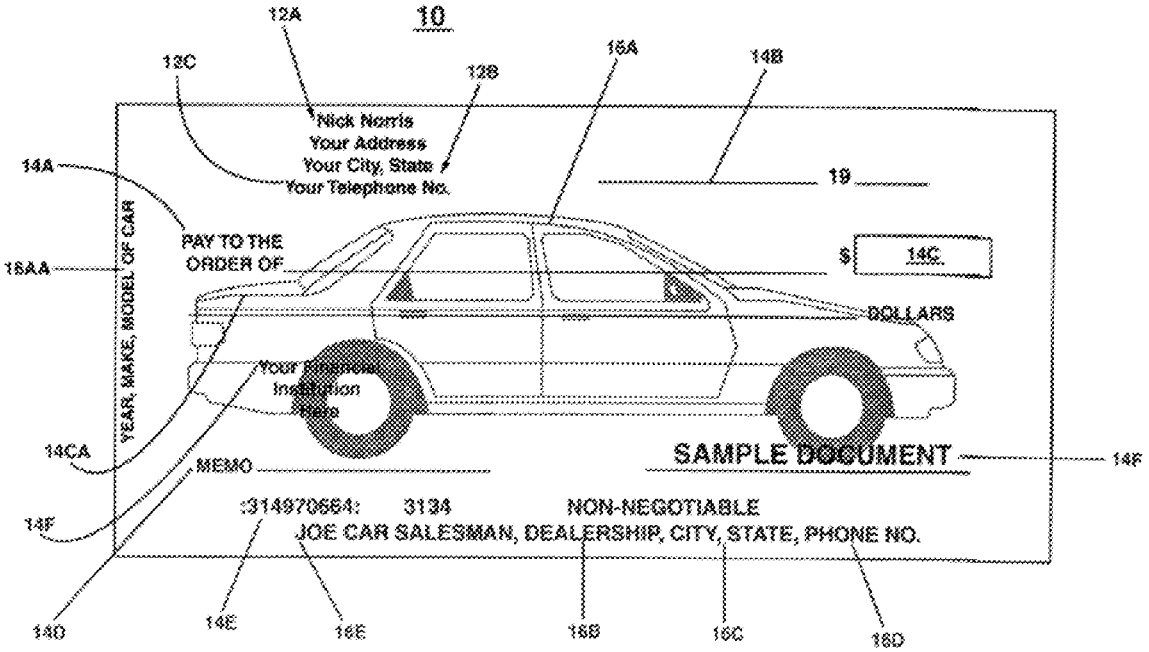
FIG. 1 is a top view of an advertising check.

Referring to FIG. 1 which is a top view of an advertising check (1O) comprising a checking account name (12A) printed thereon. The advertising check (10) further comprises a check pay endorsement (14A) printed thereon. The advertising check (10) further comprises a check date (14B) printed thereon positioned above and adjacent to the check pay endorsement (14A). The advertising check (10) further comprises a check pay amount box (14C) printed thereon. The check pay amount box (14C) further comprises a correlating check pay amount box script (14CA) printed adjacent thereto. The advertising check (10) further comprises a check financial institute clearing code (14E) printed thereon positioned along a bottom edge.

The advertising check (10) further comprises a retail product graphical display (16A) printed thereon. The retail product graphical display (16A) further comprises a correlating retail product graphical display textual information (16AA) printed adjacent thereto. The retail product graphical display (16A) is preferably printed in the background in a watermark type of printing display. The retail product graphical display (16A) may cover the entire front of the advertising check (10) or partial covering thereof. The retail product graphical display textual information (16AA) may describe a make, model, and/or manufacturer of the retail product graphical display (16A). The advertising check (10) further comprises a retail product dealer name (16B) printed thereon adjacent to the retail product graphical display (16A). The retail product dealer name (16B) would preferably be the retailer/dealer/seller/distributor of the retail product graphical display (16A). The manufacturers retail price of the retail product graphical display (16A) may optionally be printed thereon. The retail product graphical display (16A) may be a single display with one particular color or multiple colors throughout the check book containing a plurality of advertising checks (10). The retail product graphical display (16A) may optionally be a multiple display exhibiting numerous different makes and models throughout the check book containing a plurality of advertising checks (10). The advertising check (10) may optionally further comprise the retail product having a graphical display (16A) which is colored. The check book containing a plurality of advertising checks (10) may be standard single, double or triple advertising checks (10) on one page or alternatively be computer generated advertising checks (10). As new makes and models of products are unveiled each year, new retail product graphical displays (16A) are incorporated throughout the check book containing a plurality of advertising checks (10).

The advertising check (10) further comprises a retail product dealer address (16C) printed thereon adjacent to the retail product dealer name (16B). The advertising check (10) further comprises a retail product dealer telephone number (16D) printed thereon adjacent to the retail product dealer address (16C). The advertising check (10) may optionally further comprise a retail product dealer name (16B) which has a slogan printed adjacent thereto. In addition, the advertising check (10) may optionally further comprise a checking account address (12B) printed thereon positioned adjacent to the checking account name (12A). Furthermore, the advertising check (10) may optionally further comprise a checking account telephone number (12C) printed thereon positioned adjacent to the checking account address (12B). Also, the advertising check (10) may optionally further comprise a check memo (14D) printed thereon positioned below and adjacent to the check pay amount box script (14CA). Additionally, the advertising check (10) may optionally further comprise a check financial institute name and address (14F) printed thereon. The advertising check (10) may optionally further comprise a retail product salesman's name (16E) printed thereon positioned adjacent to the retail product dealer name (16B).

It will be understood that each of the elements described above, or two or more together, may also find a useful application in other types of constructions differing from the type described above.

While the invention has been illustrated and described as embodied in an advertising check, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An advertising check (10) comprising:

A) a checking account name (12A) printed thereon;

B) a check pay endorsement (14A) printed thereon;

C) a check date (14B) printed thereon positioned above and adjacent to the check pay endorsement (14A);

D) a check pay amount box (14C) printed thereon, the check pay amount box (14C) further comprises a correlating check pay amount box script (14CA) printed adjacent thereto;

E) a check financial institute clearing code (14E) printed thereon positioned along a bottom edge;

F) a retail product graphical display (16A) printed thereon, the retail product graphical display (16A) further comprises a correlating retail product graphical display textual information (16AA) printed adjacent thereto;

G) a retail product dealer name (16B) printed thereon adjacent to the retail product graphical display (16A);

H) a retail product dealer address (16C) printed thereon adjacent to the retail product dealer name (16B);

I) a retail product dealer telephone number (16D) printed thereon adjacent to the retail product dealer address (16C);

J) checking account address (12B) printed thereon positioned adjacent to the checking account name (12A);

K) a checking account telephone number (12C) printed thereon positioned adjacent to the checking account address (12B);

L) a check financial institute name and address (14F) printed thereon; and

M) a retail product salesman's name (16E) printed thereon positioned adjacent to the retail product dealer name (16B).

2. The advertising check (10) as described in claim 1, further comprises a check memo (14D) printed thereon positioned below and adjacent to the check pay amount box script (14CA).

3. The advertising check (10) as described in claim 1, wherein the retail product graphical display (16A) is colored.

4. The advertising check (10) as described in claim 1, wherein the retail product dealer name (16B) has a slogan printed adjacent thereto.

* * * * *